US010101057B2

(12) United States Patent
Giaretta et al.

(10) Patent No.: US 10,101,057 B2
(45) Date of Patent: Oct. 16, 2018

(54) HEATING UNIT FOR A FUEL AIR HEATER, METHOD FOR MANUFACTURING SAID HEATING UNIT, AND FUEL AIR HEATER COMPRISING SAID HEATING UNIT

(71) Applicant: MCS ITALY S.p.A, Verona (IT)

(72) Inventors: Enzo Giaretta, Verona (IT); Francesco Sembenini, Verona (IT)

(73) Assignee: Dantherm S.p.A, Verona (IT)

( * ) Notice: Subject to any disclaimer, the term of this patent is extended or adjusted under 35 U.S.C. 154(b) by 390 days.

(21) Appl. No.: 14/945,738

(22) Filed: Nov. 19, 2015

(65) Prior Publication Data

US 2016/0146501 A1 May 26, 2016

(30) Foreign Application Priority Data

Nov. 20, 2014 (IT) ..... MI2014A2005

(51) Int. Cl.

| | |
|---|---|
| ***F24H 3/08*** | (2006.01) |
| ***F24H 3/06*** | (2006.01) |
| ***F24H 9/18*** | (2006.01) |
| ***F24H 9/00*** | (2006.01) |
| *F24H 3/04* | (2006.01) |

(52) U.S. Cl.

CPC ..... *F24H 3/087* (2013.01); *F24H 3/065* (2013.01); *F24H 9/0063* (2013.01); *F24H 9/0068* (2013.01); *F24H 9/1881* (2013.01); *F24H 3/0417* (2013.01)

(58) Field of Classification Search

CPC . F24H 3/06; F24H 3/065; F24H 3/087; F24H 9/0063; F28D 7/10; F28D 7/103; F28D 7/106; F28D 7/12

See application file for complete search history.

(56) References Cited

U.S. PATENT DOCUMENTS 3,894,526 A * 7/1975 Kofink ..... B60H 1/2212 126/110 B
4,034,734 A * 7/1977 Birney ..... F24H 3/06 126/110 B

FOREIGN PATENT DOCUMENTS

| | | |
|---|---|---|
| DE | 90 02 588 U1 | 5/1990 |
| EP | 2 410 258 A1 | 1/2012 |
| WO | 2004/051170 A2 | 6/2004 |

OTHER PUBLICATIONS

Italian Search Report dated Aug. 4, 2015.

* cited by examiner

*Primary Examiner* — David J Laux
(74) *Attorney, Agent, or Firm* — Arent Fox LLP; Michael Fainberg

(57) ABSTRACT

Disclosed a heating unit for a portable fuel heater for heating ambient air. In one exemplary embodiment, the heating unit comprises: a first side wall defining an inner space, said inner space forming a combustion chamber; a second side wall arranged outside around said first side wall, said first side wall and said second side wall defining a first annular gap therebetween, said first annular gap forming a cooling chamber adapted to be crossed by a cooling air flow to subtract heat from the first side wall and transfer it to an external environment to be heated; wherein said first side wall forms a first plurality of bosses adapted to promote a thermal exchange of said first side wall with the combustion chamber and with the cooling chamber.

9 Claims, 5 Drawing Sheets

HEATING UNIT FOR A FUEL AIR HEATER, METHOD FOR MANUFACTURING SAID HEATING UNIT, AND FUEL AIR HEATER COMPRISING SAID HEATING UNIT

FIELD OF THE INVENTION

The present invention relates to the industrial field of portable or transportable fuel heaters, such as fluid fuel heaters, especially liquid fuel heaters, adapted to heat ambient air. In particular, the present invention relates to a heating unit which can be assembled in such a heater. The present invention further relates to a method for manufacturing such a heating unit.

BACKGROUND ART

In the field of ambient air heating by using a portable fuel heater, devices are known comprising a combustion chamber, often cylindrical in shape, inside of which a liquid or gas fuel is conducted together with an oxidizing air flow to perform a combustion. The oxidizing air flow rate inside the combustion chamber is limiting because it must be in an adapted air/fuel ratio such as to optimize the quality of the combustion. Therefore, in order to obtain a high amount of heated air, a second air flow should be used, which is not involved in the combustion and which externally laps the combustion chamber. Such a flow operatively subtracts heat from the combustion chamber and transfers it to an environment to be heated.

In certain, particularly burdensome applications, for example when a very large environment is to be heated under extreme environmental conditions, for example a mine or a worksite at a high altitude, with outside temperatures well below 0° C., sometimes even up to −40° C., there is a need to generate a flow of hot air with a high flow rate, and at the same time there is a need to transfer a high heat amount from the combustion chamber to such an air flow.

These are contradictory needs, because the higher the speed of the air flow which flows laps the combustion chamber, the lower the heat amount that such a flow is capable of receiving from the combustion chamber.

Heaters from the known art do not allow these needs to be met simultaneously.

SUMMARY OF THE INVENTION

It is the object of the present invention to devise and make available a heating unit which allows the aforesaid needs to be met while at least partially obviating the drawbacks indicated above with reference to the known art.

In particular, it is the task of the present invention to make available a fuel heater heating unit capable of improving the heating efficiency, for example capable of increasing the heat amount transferred from the combustion chamber to the environment to be heated by means of hot air.

It is therefore the object of the present invention to provide a heating unit capable of improving the thermal exchange efficiency between the combustion chamber and an air flow which externally laps the combustion chamber.

It is also the object of the invention to provide a heating unit capable of improving the heat efficiency while curbing the production costs of the heating unit itself.

It is another object of the present invention to provide a portable fuel heater capable of meeting the aforesaid needs.

It is a further object of the present invention to provide a method for manufacturing a heating unit with high heating efficiency, where such a production method is quick and affordable.

These and further objects and advantages are achieved by a heating unit in accordance with claim 1, as well as by a portable heater comprising such a heating unit, and by a method for manufacturing such a heating unit.

BRIEF DESCRIPTION OF THE DRAWINGS

Further features and advantages of the present invention will become apparent from the description below of preferred embodiments thereof, given only by way of non-limiting, indicative example, with reference to the accompanying drawings, in which.

DESCRIPTION OF EXEMPLARY EMBODIMENTS

Figure 1:
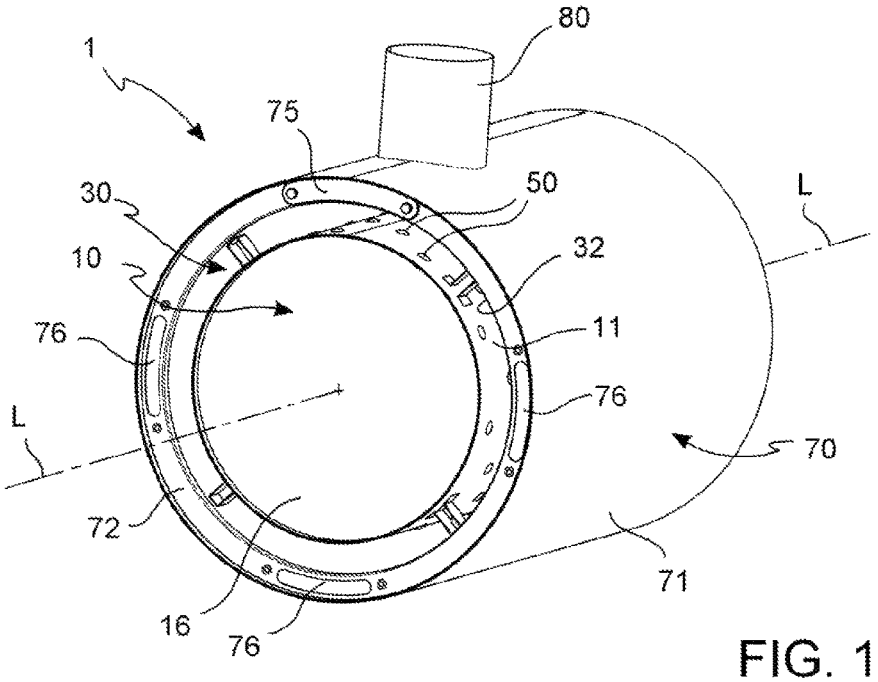
FIG. 1 shows a perspective view of a heating unit according to the invention.
Figure 2:
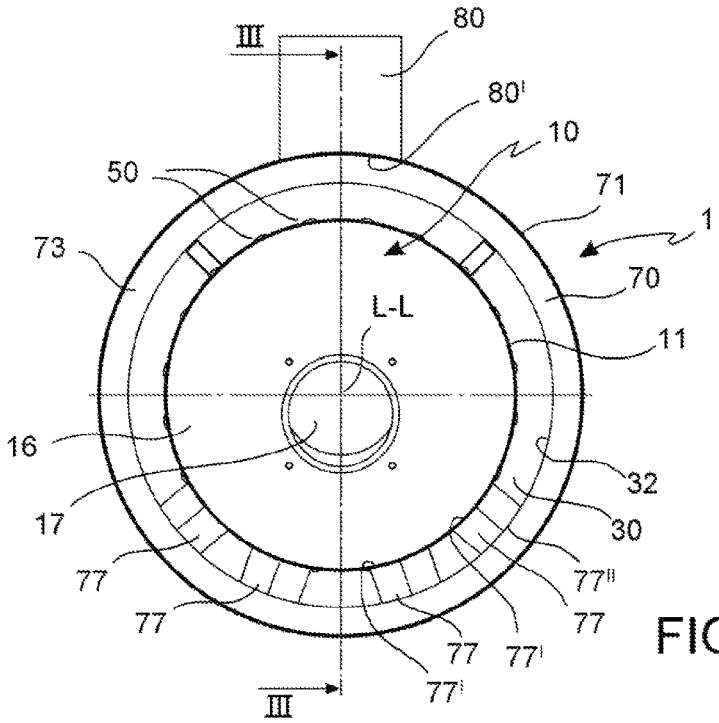
FIG. 2 shows a front orthogonal view of the heating unit in FIG. 1.
Figure 3:
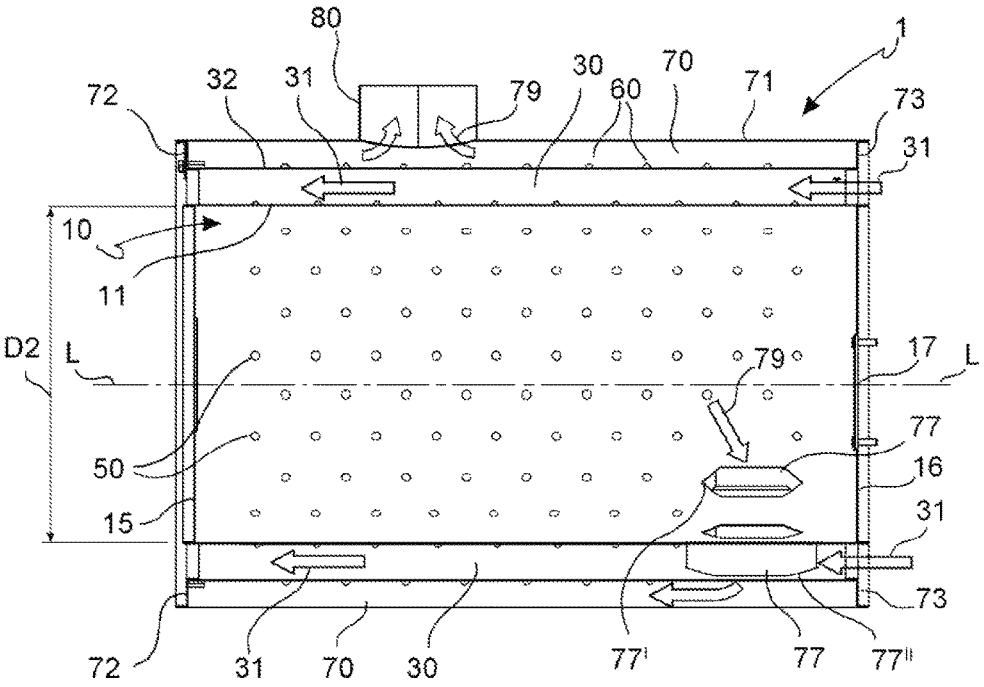
FIG. 3 shows a sectional view of the heating unit in FIG. 1, according to a longitudinal sectional plane III.

With reference to the drawings, a heating unit for a fuel heater adapted to heat ambient air according to the invention is indicated as a whole with numeral 1.

The heating unit 1 comprises a first side wall 11 defining an inner space which forms a combustion chamber 10.

Such a first side wall 11 is a substantially closed side wall.

Such a first wall extends, for example, around a main extension axis L-L of the combustion chamber 10, the extension axis L-L being rectilinear, for example.

In other words, the section of the first side wall 11 with a plane orthogonal to a main extension axis L-L of the combustion chamber 10 is a closed section, or a closed line, or follows a closed path.

In other words, the first side wall 11 is a tubular wall.

In accordance with an embodiment, the first side wall 11 is substantially cylindrical.

The heater unit 1 comprises an annular cooling chamber 30 which externally surrounds at least one portion of the combustion chamber 11, for example which externally surrounds the first side wall 11.

The heating unit comprises a second side wall 32 arranged outside around the first side wall 11. Thereby, the first side wall 11 and the second side wall 32 define a first annular gap therebetween, which forms a cooling chamber 30.

In accordance with an embodiment, the second side wall 32 is a substantially closed side wall which extends around the main extension axis L-L of the combustion chamber 10.

In other words, the section of the second side wall 32 with a plane orthogonal to the main extension axis L-L of the combustion chamber 10 is a closed section, or a closed line, or follows a closed path.

In other words, the second side wall 32 is a tubular wall.

In accordance with an embodiment, the second side wall 32 is substantially cylindrical.

In accordance with an embodiment, the second side wall 32 is coaxial with the cylindrical first side wall 11.

The first side wall 11 separates the combustion chamber 10 from the cooling chamber 30.

The cooling chamber 30 is adapted to be crossed by a cooling air flow 31 to subtract heat from the first side wall 11 and transfer it to an external environment to be heated.

The first side wall 11 comprises a first plurality of bosses 50 adapted to promote a thermal exchange of said first side wall 11 with the combustion chamber 10 and with the cooling chamber 30.

The presence of such bosses provides an important advantage. Such bosses indeed interrupt the linearity of the outer surface of the first side wall 11, thus deflecting the flow lines of the air or of the combustion fumes which in use flow along such a wall. In particular, the flow lines of the air or of the combustion fumes at such bosses are deflected with respect to the laminar trend which they would have in the absence of the bosses.

In other words, the presence of the bosses varies the motion of the fluids which lap the combustion chamber wall on opposite sides, from laminar motion to turbulent motion.

This maximizes the transmission of heat from the combustion chamber towards the cooling air, and thereby the cooling air flow which is then introduced into an environment to be heated, transfers a high heat amount to the environment, also for high cooling air flow rates. Thereby, the heating efficiency significantly improves.

In accordance with an embodiment, the bosses of the first plurality of bosses 50 project from the first side wall towards the outside of the combustion chamber 10 so as to be hit by the cooling air flow 31 which crosses the cooling chamber 30. In other words, the bosses of the first plurality of bosses extend radially outward with respect to the main extension axis L-L.

This particular arrangement allows increased turbulent motion to be generated in the cooling chamber with respect to the combustion chamber.

In accordance with an embodiment, the bosses of the first plurality of bosses 50 are distributed according to parallel rows 13, 14, for example according to a matrix.

In accordance with an embodiment, such bosses 50 of each row 13 are offset with respect to the bosses of each adjacent row 14.

Thereby, the cooling air flow which externally laps the wall of the combustion chamber may reach all the bosses under similar fluid-dynamic conditions, thus avoiding to be obstructed by previous bosses along an advancing direction of the flow.

In accordance with an embodiment, the bosses 50 of each row 13 are offset with respect to the bosses of each adjacent row 14 by a value substantially equal to half the distance between two adjacent bosses in the same row 14.

In accordance with an embodiment, the bosses are axisymmetric in shape.

In accordance with an embodiment, the intersection between at least one boss of said first plurality of bosses 50 with a plane P' tangent to the first wall 11 at said at least one boss defines a boss base section 51, in which said boss base section 51 is substantially annular, in particular circular annular in shape.

In accordance with an embodiment, the boss base section 51 is circular in shape.

In accordance with an embodiment, the intersection 52 of said at least one boss of said first plurality of bosses 50 with a plane orthogonal to a plane P' tangent to the first wall 11 at said at least one boss is substantially arc shaped. In particular, such an orthogonal plane passes through a middle symmetry axis of said at least one boss.

Figure 4A:
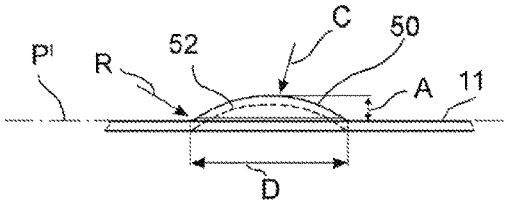
FIG. 4A shows a detail of the heating unit in FIG. 1, in which a boss of a first plurality of bosses is shown in side view.
Figure 5A:
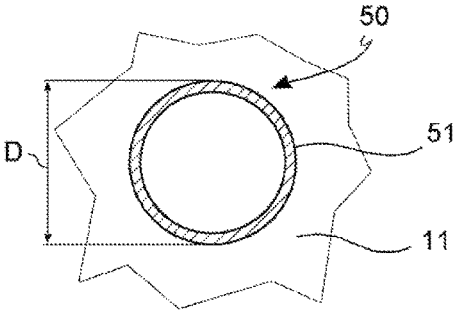
FIG. 5A shows a sectional view of the boss in FIG. 4A, according to a sectional plane tangent to a first side wall of the heating unit, at the boss.

An example of such an embodiment is shown in FIGS. 4A and 5A.

The bosses 50 have an outer surface joined with an outer surface of the first side wall only by means of curved surfaces, thus avoiding sharp corner intersections.

Thereby, a high dynamic efficiency of the cooling air flow is obtained, thus reducing the losses of fluid flow load. In other words, the rounded shape of the bosses avoids reducing the outlet speed of the cooling air heated by the heater.

In accordance with an embodiment, the bosses 50 have an outer boss diameter of preset value D, for example ranging between 15 mm and 30 mm, preferably equal to approximately 21 mm.

In accordance with an embodiment, the bosses 50 project from the first side wall, in particular radially, according a preset boss height A, in particular ranging between 2 mm and 5 mm, preferably approximately 3 mm.

In accordance with an embodiment, the bosses 50 have a preset outer curvature radius C, for example ranging between 12 mm and 20 mm, preferably approximately 16 mm.

In accordance with an embodiment, the bosses 50 are joined with an outer surface of the first side wall 11 of the combustion chamber by means of a preset connection radius R.

For example, the preset connection radius R ranges between 1 mm and 4 mm, preferably 3 mm.

In accordance with an embodiment, the boss height A is approximately ⅙ of the boss outer diameter D.

In accordance with an embodiment, the bosses of the first plurality of bosses are arranged over 19 rows which are substantially parallel to the main extension axis L-L. For example, said rows 13, 14 comprise from 1 to 4 bosses each. For example, each row comprises 4 bosses.

In accordance with an embodiment, the distance between two adjacent bosses along the same row 13, 14 is from 4 to 8 times greater than the outer diameter of boss D, for example approximately 6 times greater.

In accordance with an embodiment, the distance between two adjacent bosses 50 measured on the same row 13, 14 is approximately twice the distance between two adjacent rows 13, 14.

In accordance with an embodiment, the ratio of the inner diameter D2 of the cylindrical first side wall 11 with the outer diameter of boss D ranges between 25 and 45, for example is approximately 38.

In accordance with an embodiment, the bosses of the first plurality of bosses 50 are obtained by means of plastic deformation, or embossing, of a metal sheet. Thereby, the first plurality of bosses 50 is formed in one piece with said first side wall 11 or with said sheet.

The first side wall 11 may consist of, or may comprise, an embossed sheet comprising said first plurality of bosses 50, for example said sheet being bent to form said first side wall.

The bosses of said plurality of bosses 50 have a convexity which projects from one face of the wall, or sheet, and a concavity which penetrates the wall, or sheet, on an opposite side of the wall, or sheet, at the convexity (FIG. 4). The resulting bosses connect to the wall, or sheet, to which they belong, for example in a rounded manner.

In accordance with an embodiment, the thickness of the first side wall 11 is constant along the wall even at the bosses of said first plurality of bosses 50.

In accordance with an embodiment, the heating unit 1 comprises a third side wall 71 arranged outside around said second side wall 32, said third side wall 71 and said second side wall 32 defining a second annular gap therebetween, said second annular gap forming a fumes evacuation chamber 70 adapted to be crossed by a flow of combustion fumes 79 from said combustion chamber 10.

Such a third side wall 71 is a substantially closed side wall which extends around the main extension axis L-L of the combustion chamber 10.

In other words, the cross-section of the third side wall 71 through a section plane orthogonal to the main extension axis L-L of the combustion chamber 10 is a closed cross-section, or a closed line, or follows a closed path.

In other words, the third side wall 71 is a tubular wall.

In accordance with an embodiment, the third side wall 71 is substantially cylindrical.

In accordance with an embodiment, the third side wall 71 is coaxial with the cylindrical second side wall, in particular is coaxial with the cylindrical first side wall 11.

The fumes evacuation chamber 70 is separated from the cooling chamber 30 by means of the second side wall 32.

In accordance with an embodiment, the heating unit 1 further comprises connection conduits 77 for the combustion fumes 79 to pass between the combustion chamber 10 and the fumes evacuation chamber 70.

In accordance with an embodiment, the heating unit further comprises a flue 80 for fumes 79 to exit from the fumes evacuation chamber 70.

In accordance with an embodiment, the second side wall 32 comprises a second plurality of bosses 60 projecting from the second side wall 32.

In accordance with an embodiment, the bosses of the second plurality of bosses 60 project from the second side wall 32 towards the outside of the cooling chamber 32 so as to be hit by a flow of combustion fumes 79 from the combustion chamber 10 which flow into said fumes evacuation chamber.

In other words, the bosses of the second plurality of bosses 60 project from the second side wall 32 radially outwardly with respect to the main extension axis L-L of the combustion chamber.

The second side wall 32 may consist of, or may comprise, an embossed sheet comprising said second plurality of bosses 60, for example said sheet being bent to form said second side wall 32.

The second plurality of bosses 60 may be formed in one piece with said second side wall 32 or with said sheet.

In accordance with an embodiment, the thickness of the second side wall 32 is uniform along the wall also at the bosses of said second plurality of bosses 60.

The bosses of said second plurality of bosses 60 which have a convexity which projects from one face of the second wall 32, and a concavity which penetrates the second wall 32 on an opposite side of the wall at the convexity.

In accordance with an embodiment, the bosses of the second plurality of bosses 60 are distributed according to parallel rows 33, 34.

Furthermore, in accordance with an embodiment, the bosses 60 of each row 33 are offset with respect to the bosses 60 of each adjacent row 34.

Thereby, the flow of combustion fumes 79 which externally laps the wall of the cooling chamber 32, or second side wall, may reach all the bosses 60 under similar fluid-dynamic conditions, thus avoiding to be obstructed by previous bosses in the advancing direction of the flow.

In accordance with an embodiment, the bosses 60 of each row 33 are offset with respect to the bosses of each adjacent row 34 by a value substantially equal to half the distance between two adjacent bosses in the same row 34.

In accordance with an embodiment, the bosses of the first plurality of bosses 50 are misaligned with respect to the bosses of said second plurality of bosses 60.

In accordance with an embodiment, the intersection between at least one boss of said second plurality of bosses 60 with a section plane P" tangent to the second wall 32 at said at least one boss defines a second boss base section 61, in which said second boss base section 61 is substantially annular, in particular circular annular in shape.

In accordance with an embodiment, the second boss base section 61 is circular in shape.

In accordance with an embodiment, the intersection 62 of said at least one boss of said second plurality of bosses 60 with a section plane orthogonal to the plane P" tangent to the second wall 32 at said at least one boss, is substantially arc shaped. In particular, such an orthogonal plane passes through a middle symmetry axis of said at least one boss.

Figure 4B:
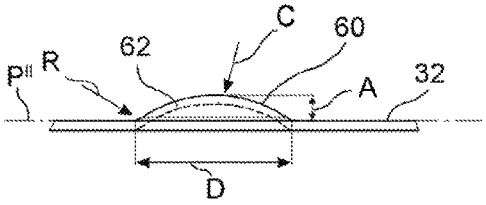
FIG. 4B shows a detail of the heating unit in FIG. 1, in which a boss of a second plurality of bosses is shown in side view.
Figure 5B:
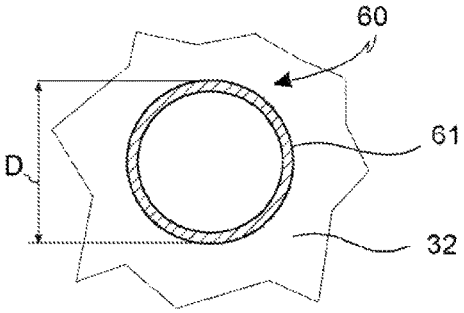
FIG. 5B shows a sectional view of the boss in FIG. 4B, according to a sectional plane tangent to a second side wall of the heating unit, at the boss.
Figure 6:
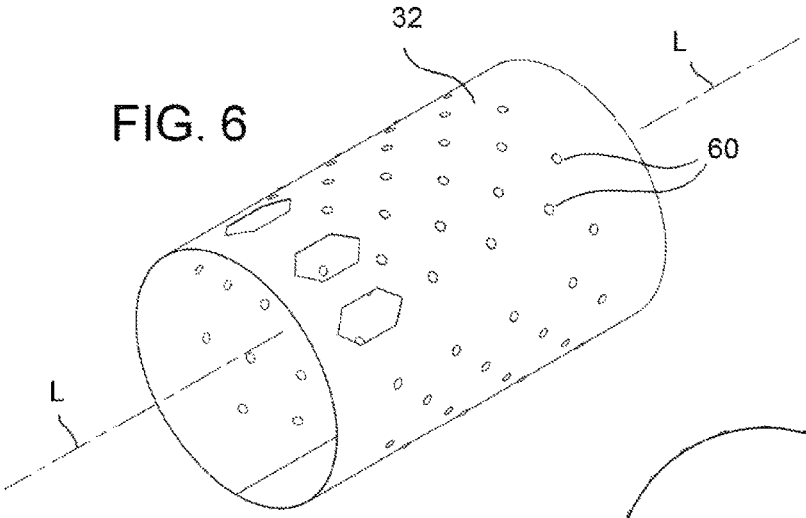
FIG. 6 shows a perspective view of a second side wall of the heating unit in FIG. 1.
Figure 7:
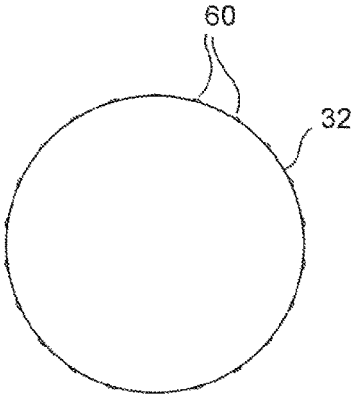
FIG. 7 shows an orthogonal front view of the second side wall in FIG. 6.
Figure 8:
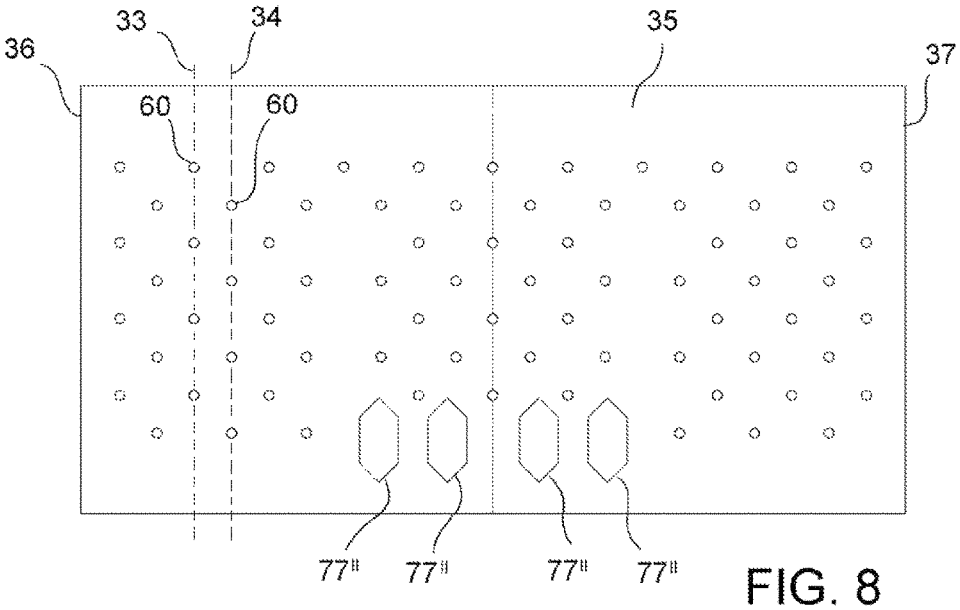
FIG. 8 shows the second side wall in FIG. 6, open and developed on a plane.
Figure 9:
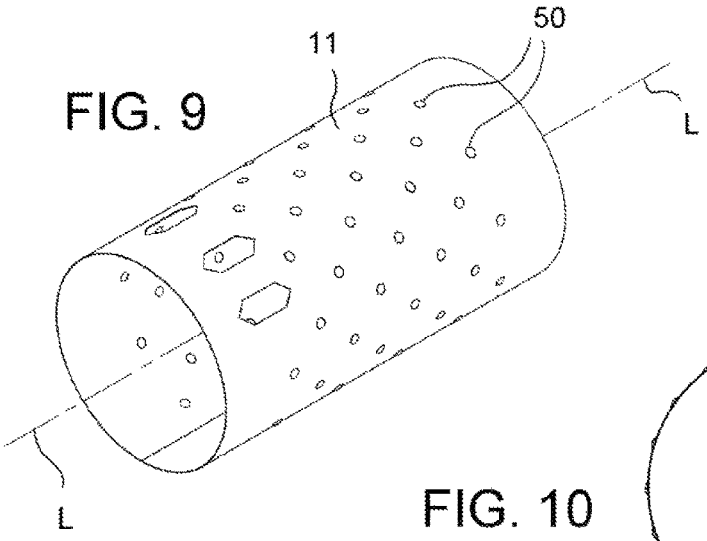
FIG. 9 shows a perspective view of a first side wall of the heating unit in FIG. 1.
Figure 10:
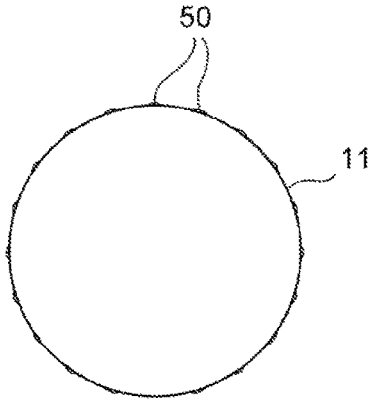
FIG. 10 shows an orthogonal front view of the first wall in FIG. 6.
Figure 11:
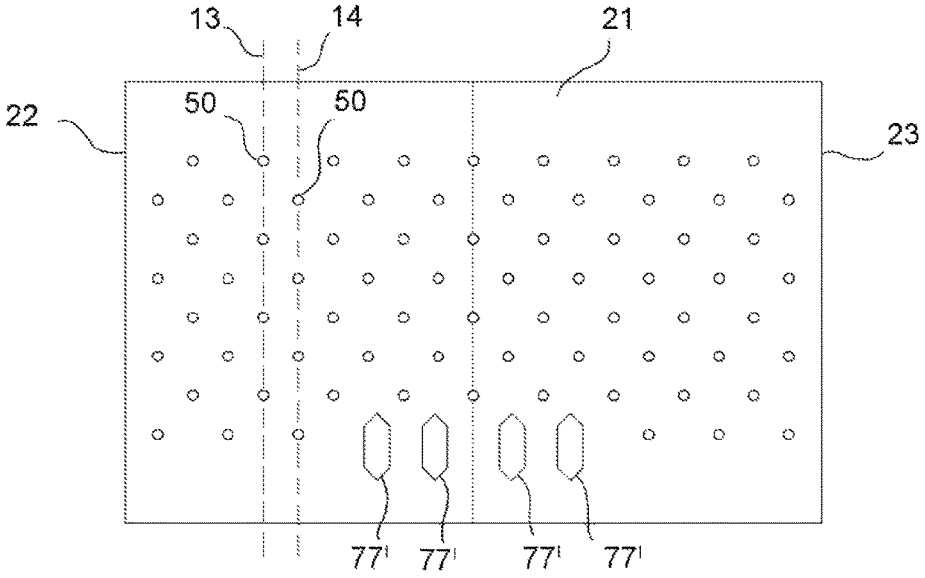
FIG. 11 shows the first side wall in FIG. 6, open and developed on a plane.
Figure 12:
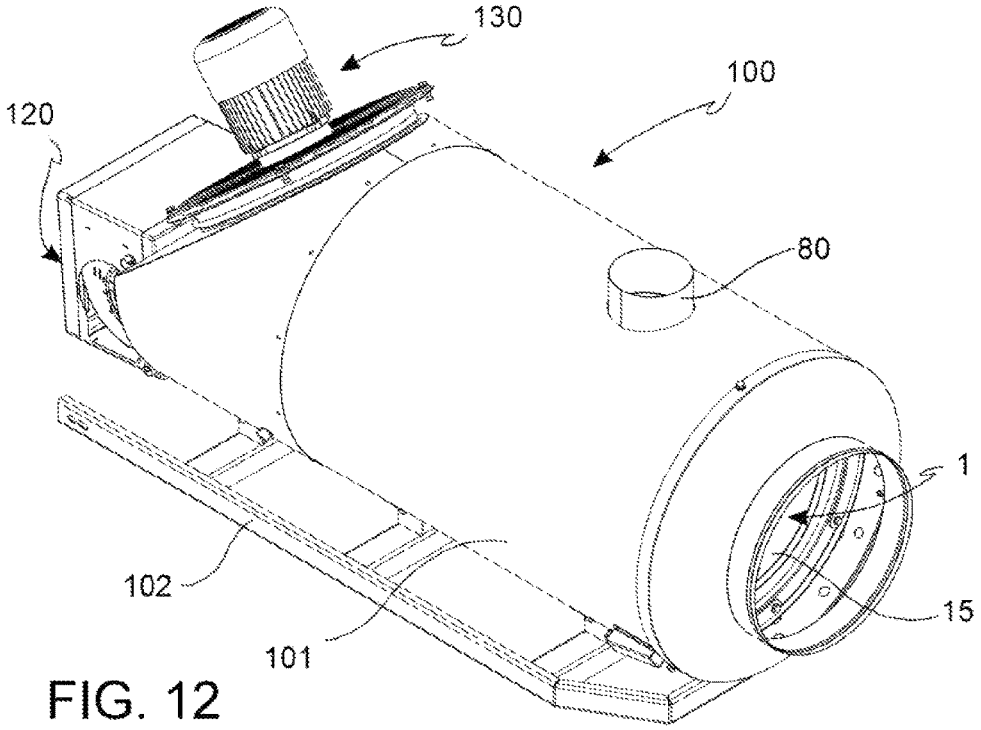
FIG. 12 shows a perspective view of a portable heater comprising the heating unit in FIG. 1.
Figure 13:
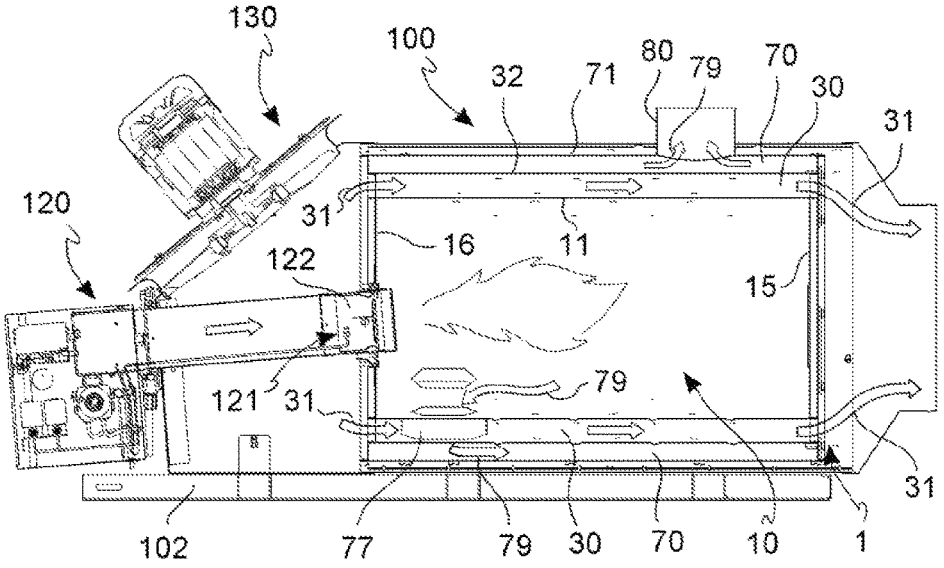
FIG. 13 shows a sectional view of the heater in FIG. 12, sectioned according to a longitudinal sectional plane.

An example of such an embodiment is shown in FIGS. 4B and 5B.

In accordance with an embodiment, the bosses of the first plurality of bosses 50 have a shape and dimensions substantially equal to the shape and dimensions of the bosses of the second plurality of bosses 60.

In accordance with an embodiment, the bosses of the second plurality of bosses 60 are arranged over 21 rows which are substantially parallel to the main extension axis L-L. For example, said rows 33, 34 comprise from 1 to 4 bosses each one.

In accordance with an embodiment, the bosses of said second plurality of bosses 60 are obtained by means of the plastic deformation, or embossing, of metal sheet.

As described for the bosses 50 of the first side wall 11, the bosses 60 of the second side wall are also obtained in the same manner and have similar advantages.

In accordance with an embodiment, the combustion chamber 10 is a closed chamber having an inlet opening 17 for oxidizing air and fuel and having at least one outlet opening 77' for evacuating the gases or fumes generated by the combustion, in particular in the connection conduits 77 for the combustion fumes 79 to pass between the combustion chamber 10 and the fumes evacuation chamber 70.

In accordance with an embodiment, the combustion chamber 10 comprises two opposite base walls 15, 16, which close two opposite free ends, respectively, of the first side wall 11.

In accordance with an embodiment, one base wall 16 of said two base walls 15, 16 comprises said inlet opening 17 for oxidizing air and fuel.

In accordance with an embodiment, the first side wall comprises said at least one outlet opening 77'.

In accordance with an embodiment, the first side wall is cylindrical and the base walls 15, 16 are flat walls orthogonal to the main extension axis L-L of the first side wall.

In accordance with an embodiment, the fumes evacuation chamber 70 is a closed chamber having at least one inlet opening 77" for receiving the combustion fumes from the combustion chamber 10 and having at least one outlet opening 80' for evacuating the combustion fumes into an outlet flue 80.

In accordance with an embodiment, the second side wall 32 comprises the at least one inlet opening 77" for receiving the combustion fumes from the combustion chamber 10.

In accordance with an embodiment, the second side wall 70 comprises the at least one outlet opening 80' for evacuating the combustion fumes into an outlet flue 80.

In accordance with an embodiment, the second side wall 32 has a first base end and an opposite second base end, and the third side wall has a third base end and an opposite fourth base end.

In accordance with an embodiment, the second side wall 32 is substantially tubular in shape.

In accordance with an embodiment, the third side wall is substantially tubular in shape.

For example, the second side wall 32 extends over a length measured between the first base end and the second base end, substantially equal to an extension length of said third side wall 71 measured between the third base end and the fourth base end.

In accordance with an embodiment, the fumes evacuation chamber 70 is further defined by a first annular base wall which connects the first base end and the third base end together, thus closing a first end of the fumes evacuation chamber 70, and by a second annular base wall which connects the second base end and the fourth base end together, thus closing a second end of the fumes evacuation chamber 70.

In accordance with an embodiment, at least one between said first annular base wall 72 and said second annular base wall 73 comprises at least one opening 76 adapted to allow the interior of said fumes evacuation chamber 70 to be cleaned, and at least one corresponding closing member 75 to close said at least one opening 76 in a removable manner.

In accordance with an embodiment, the first annular base wall 72 is substantially flat. In accordance with an embodiment, the second annular base wall 73 is substantially flat. In accordance with an embodiment, the at least one opening 76 is in the shape of an annular portion. In accordance with an embodiment, the closing member 75 is a flat plate, for example a flat plate which extends along an annular portion, for example so as to cover and close said at least one opening 76 in the shape of an annular portion.

A method according to the invention for manufacturing a heating unit as described above, will now be described.

The method for manufacturing a heating unit 1 as described above firstly comprises a step of providing a first metal sheet 21.

In accordance with an embodiment, the first metal sheet has two opposite end edges 22, 23.

In accordance with an embodiment, the method comprises a step of cutting said first sheet 21 so that said sheet 21 has two substantially rectilinear opposite end edges 22, 23, for example substantially parallel to each other. Thereby, the first sheet 21 is adapted to be bent to form a cylinder.

The method further comprises a step of forming, for example by sheet pressing, a first plurality of bosses 50 on said first metal sheet 21 to obtain an embossed sheet.

In accordance with an embodiment, the method comprises a step of providing at least two calendering rolls, in which at least one of said at least two rolls comprises an elastically deformable outer layer, in which said outer layer has such an elasticity value as to avoid said first bosses 50 from being operatively deformed.

In accordance with an embodiment, the method comprises a step of calendering said embossed sheet by means of said at least two calendering rolls to fold said sheet so as to match said two opposite end edges 22, 23 with each other, thus forming said first side wall 11 defining said combustion chamber 10.

In accordance with an embodiment, the aforesaid step of forming, for example by pressing, a first plurality of bosses 50, comprises a step of providing an embossing die, in which said embossing die is configured to make said first plurality of bosses 50 on said first sheet 21, and a step of deforming said first sheet 21 by means of said embossing die.

In accordance with an embodiment, the step of forming a first plurality of bosses 50 comprises a step of providing a numerically controlled punching machine adapted to emboss a plurality of bosses in sequence on said first sheet 21, a step of actuating said punching machine so as to form said first plurality of bosses (50) on said first sheet (21).

The method further comprises a step of joining said two opposite edges 22, 23 of said first sheet together, thus forming a first side wall 11, for example by means of welding or riveting.

In accordance with an embodiment, the method comprises a step of making at least one fumes outlet opening 77' through said first sheet 21, for example by means of punching or laser cutting.

In accordance with an embodiment, the method comprises a step of providing a second metal sheet 35 and of applying the steps described above so as to obtain a second side wall 32 comprising a second plurality of bosses 60.

In particular, in accordance with an embodiment, the method comprises a step of providing a second metal sheet 35.

In accordance with an embodiment, the second metal sheet 35 has two opposite end edges 36, 37.

In accordance with an embodiment, the method comprises a step of cutting said second sheet 35 so that said sheet 35 has two substantially rectilinear opposite end edges 36, 37, for example substantially parallel to each other. Thereby, the second sheet 21 is adapted to be bent to form a cylinder.

The method further comprises a step of forming, for example by pressing, a second plurality of bosses 60 on said second metal sheet 35, thus forming an embossed sheet.

In accordance with an embodiment, the method comprises a step of providing at least two calendering rolls, in which at least one of said at least two rolls comprises an elastically deformable outer layer, in which said outer layer has such an elasticity value as to avoid said second plurality of bosses 60 from being operatively deformed.

The method further comprises a step of calendering said embossed sheet by means of said at least two calendering rolls to fold said second sheet so as to match said two opposite end edges 36, 37 with each other, thus forming said second side wall 11 defining said cooling chamber 30.

In accordance with an embodiment, the aforesaid step of forming a second plurality of bosses 60 comprises a step of providing a embossing die, in which said mold is configured to make said second plurality of bosses 60 on said second sheet 35, and a step of pressing said second sheet 35 by means of said embossing die.

In accordance with an embodiment, the step of forming a second plurality of bosses 60 comprises a step of providing a numerically controlled punching machine adapted to emboss a second plurality of bosses in sequence on said second sheet 35, a step of actuating said punching machine so as to form said second plurality of bosses 60 on said second sheet 35.

The method further comprises a step of joining said two opposite edges 36, 37 of said second sheet together, thus forming said second side wall 32, for example by means of welding or riveting.

In accordance with an embodiment, the method comprises a step of making at least one fumes outlet opening 77' through said second sheet 21, for example by means of punching or laser cutting.

With reference to the drawings, a portable fuel heater for heating ambient air comprising a heating unit as described above is indicated as a whole with numeral 100.

Heater 100 comprises a first forced ventilation device 120 for supplying oxidizing air in said combustion chamber 10; a liquid or gas fuel dispensing device 121 for dispensing fuel in combustion chamber 10, or towards the combustion chamber; an ignition device 122 for starting a combustion in combustion chamber 10; a second forced ventilation device 130 for supplying said cooling air flow 31 in said cooling chamber 30.

Furthermore, heater 100 comprises an outer casing 101 containing said heating unit 1.

In accordance with an embodiment, casing 101 may be dimensioned to also contain therein at least one of: the liquid or gas fuel dispensing device 121 for dispensing fuel in combustion chamber 10; the ignition device 122 for starting a combustion in combustion chamber 10; the first forced ventilation device 120; the second forced ventilation device 130.

In accordance with an embodiment, heater 100 comprises a supporting cart with wheels for moving said heater 100. In other words, heater 100 may be wheeled and towable by a transport means to be easily transferred and located in a place wherein it is used.

In accordance with an embodiment, heater 1 comprises a motorized system.

Those skilled in the art may make several changes and adaptations to the above-described embodiments of the device, and may replace elements with others which are functionally equivalent in order to meet contingent needs, without departing from the scope of the following claims. Each of the features described as belonging to a possible embodiment can be achieved irrespective of the other embodiments described.

The invention claimed is:

1. A portable fuel heater for heating ambient air, comprising a heating unit comprising:

a first side wall defining an inner space, said inner space forming a combustion chamber;

a second side wall arranged outside around said first side wall, said first side wall and said second side wall defining a first annular gap therebetween, said first annular gap forming a cooling chamber adapted to be crossed by a cooling air flow to subtract heat from the first side wall and transfer it to an external environment to be heated;

wherein said first side wall forms a first plurality of bosses adapted to promote a thermal exchange of said first side wall with the combustion chamber and with the cooling chamber, a third side wall arranged outside around said second side wall, said third side wall and said second side wall defining a second annular gap therebetween, said second annular gap forming a fumes evacuation chamber adapted to be crossed by a flow of combustion fumes from said combustion chamber, wherein said second side wall forms a second plurality of bosses adapted to promote a thermal exchange of said second side wall with said cooling chamber and with said fumes evacuation chamber, wherein the bosses of the first plurality of bosses are unaligned with respect to the bosses of said second plurality of bosses.

2. A portable fuel heater according to claim 1, further comprising:

a first forced ventilation device for supplying oxidizing air in said combustion chamber;

a fuel dispensing device for dispensing atomized liquid or gas fuel in, or towards, the combustion chamber;

an ignition device for starting a combustion of said fuel;

a second forced ventilation device for supplying said cooling air flow in said cooling chamber, an outer casing containing said heating unit;

a supporting cart with wheels for moving said heater.

3. The portable fuel heater of claim 1, wherein the bosses of said first plurality of bosses project towards the outside of the combustion chamber so as to be hit by said cooling air flow.

4. The portable fuel heater of claim 1, wherein the bosses of the first plurality of bosses are distributed according to parallel rows, wherein the bosses of each row are offset with respect to the bosses of each adjacent row.

5. The portable fuel heater of claim 1, wherein the intersection between at least one boss of said first plurality of bosses and a plane tangent to the first side wall at said at least one boss, forms a boss base section, wherein said boss base section is substantially circular ring-shaped.

6. The portable fuel heater of claim 1, wherein the intersection of said at least one boss of said first plurality of bosses with a plane orthogonal to the tangent plane at the boss is substantially arc-shaped.

7. The portable fuel heater of claim 1, wherein the bosses of said second plurality of bosses project from said second side wall towards the outside of said cooling chamber so as to be hit by said flow of combustion fumes.

8. The portable fuel heater of claim 1, wherein the bosses of the second plurality of bosses have a substantially equal shape or size to that of the bosses of the first plurality of bosses.

9. The portable fuel heater of claim 1, wherein said second side wall has a first base end and an opposite second base end, and the third side wall has a third base end and an opposite fourth base end, wherein the fumes evacuation chamber is further defined by a first annular base wall connecting the first base end and the third base end together, thus closing a first end of the fumes evacuation chamber, and by a second annular base wall connecting the second base end and the fourth base end together, thus closing a second end of the fumes evacuation chamber, wherein at least one of said first annular base wall and said second annular base wall comprises at least one opening adapted to allow the interior of said fumes evacuation chamber to be cleaned, and at least one corresponding closing member to close said at least one opening in a removable manner.

* * * * *